US006158747A

United States Patent [19]

Magnani

[11] Patent Number: 6,158,747

[45] Date of Patent: Dec. 12, 2000

[54] SKIING EQUIPMENT AND AN ACCESSORY FOR DAMPING THE FLEXURAL VIBRATIONS OF A SKI

[76] Inventor: Mario Magnani, Via della Vittoria, 41-I-13051 Biella, Torino, Italy

[21] Appl. No.: 09/117,361

[22] PCT Filed: Feb. 1, 1996

[86] PCT No.: PCT/EP97/00421

§ 371 Date: Jul. 28, 1998

§ 102(e) Date: Jul. 28, 1998

[87] PCT Pub. No.: WO97/27915

PCT Pub. Date: Aug. 7, 1997

[30] Foreign Application Priority Data

Feb. 1, 1996 [IT] Italy ..... VC96A0001

[51] Int. Cl.[7] ..... A63C 1/24

[52] U.S. Cl. ..... 280/11.14; 280/602

[58] Field of Search ..... 280/602, 11.14, 280/601, 618, 607, 636

[56] References Cited

U.S. PATENT DOCUMENTS

| | | | |
|---|---|---|---|
| 5,213,355 | 5/1993 | Juhasz | 280/602 |
| 5,499,836 | 3/1996 | Juhasz | 280/602 |
| 5,775,716 | 7/1998 | Harsanyi et al. | 280/602 |

*Primary Examiner*—Kevin Hurley
*Assistant Examiner*—Kevin McKinley
*Attorney, Agent, or Firm*—Sughrue, Mion, Zinn, Macpeak & Seas, PLLC

[57] ABSTRACT

Skiing equipment includes an elastically deformable structure which can assume a variety of curved configurations as a function of the dynamic actions occurring in use. The equipment includes at least one deformable chamber filled with a damping fluid and disposed in such a way that the variations in configuration of the deformable structure cause corresponding variations in the form of at least a part of the deformable chamber.

9 Claims, 4 Drawing Sheets

32
42
46
48
50
52
54
56
58
60
62
64
66
34
36
34a
34b
36a
36b

SKIING EQUIPMENT AND AN ACCESSORY FOR DAMPING THE FLEXURAL VIBRATIONS OF A SKI

BACKGROUND OF THE INVENTION

The present invention relates to skiing equipment. In the following description and in the claims, this term is intended to include any equipment which allows the user to slide on snow clad slopes to practice any type of skiing discipline, such as, for example skis, snowboards and the like.

More precisely, the invention relates to equipment of the type comprising a resiliently deformable structure which is able to assume a variety of curved configurations in dependence on the dynamic actions which develop during use, and which is provided with means for damping its flexural vibrations.

Various systems have already been proposed which have the purpose of damping elastic oscillations of skis. In effect, flexural vibrations of skis represent an entirely unwanted phenomenon which, especially in use at high speed or on icy slopes, produces a loss of contact with the ground, a reduced capacity to hold to a curve, less control over the path of the equipment and impacts with the ground which increase the sliding friction.

Currently, state of the art industrial ski construction provides for different layers of materials such as wood, metal, thermoplastic materials, glass fibres, carbon fibres, thermosetting resins etc to be joined together, and utilises different parameters of resistance to flexion and torsion of each of the said materials to provide skis with given characteristics of elasticity and viscoelasticity capable of partly damping the flexural vibrations. Currently, the use of spacers (the so-called antivibration plates) fitted to the centre of the ski, already widely used in competitive alpine skiing, is being extended into the tourist and amateur sectors. These spacers or plates are not truly dampers and principally have the purpose of raising the boot binding from the ground to allow greater inclination in curves.

SUMMARY OF THE INVENTION

The present invention has the object of providing a system for damping flexural vibrations of skis, snowboards and the like, which is more effective than arrangements known up to now.

The present invention is essentially based on the principal of providing a deformable chamber filled with a damping fluid and disposed in such a way that the variations in the configuration of the ski, snowboard or the like, produce corresponding variations in the form of at least part of the deformable chamber.

Thanks to this arrangement the variations in the geometry of the ski cause a movement of damping fluid within the deformable chamber. The work necessary for the displacement of the damping fluid causes a damping of the vibrational motion of the ski. The magnitude of the damping can be varied at the design stage by a choice of the characteristics of the fluid or by providing restricted, possibly adjustable, flow cross-sections within the deformable chamber.

The system according to the present invention can be integrated into the structure of the ski, snowboard or the like or can be formed as an accessory which can be fixed on to the upper surface of any known type of ski like one of the said plates, which make it possible to increase the distance between the boot and the ground. Alternatively, the accessory can be fixed forwardly or rearwardly of the bindings, without influencing them.

The vibration damping system according to the present invention may possibly be associated with an elastic device comprising one or more flat springs subject to a variable pre-loading, which allow variation in the rigidity characteristics of the ski as well as its shape at rest.

The damping system according to the present invention behaves like a hydraulic or gas damper and acts to damp the elastic return oscillation after a flexing stress. One of the advantages of the system according to the invention is that it does not require the use of conventional piston-type dampers which would require mechanical members such as arms, levers or tie rods and would lead to a considerable increase in the weight and size of the ski. On the contrary, in the arrangement according to the present invention, both the weight and size of the ski can be kept to the same order of magnitude as those of a traditional type of ski, possibly provided with binding plates of average weight.

BRIEF DESCRIPTION OF THE DRAWINGS

Further characteristics and advantages of the present invention will become apparent during the course of the following detailed description given purely by way of non-limitative example with reference to the attached drawings, in which.

DETAILED DESCRIPTION OF THE INVENTION

Figure 1:
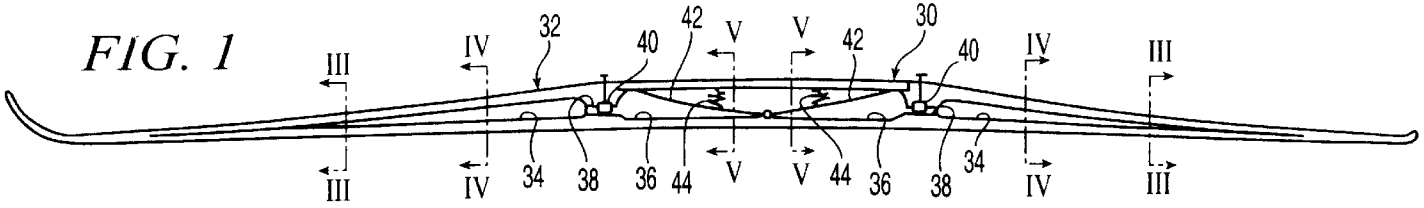
FIG. 1 is a schematic longitudinal section of a ski according to the present invention.

With reference initially to FIGS. 1 to 8, reference numeral 30 indicates a ski having a resiliently deformable structure 32 within which are formed two deformable chambers 34. The two deformable chambers 34 extend longitudinally within both the forward portion and the tail portion of the ski. In the central portion of the ski, generally intended for the fixing of the bindings, there are formed two compensation chambers 36 each of which is in fluid communication with a respective deformable chamber 34. Communication between the deformable chambers 34 and the compensation chambers 36 takes place via respective narrow passages 38 at which there is optionally provided adjustment means 40 for adjusting the flow cross-section of the passage 38.

Figure 2:
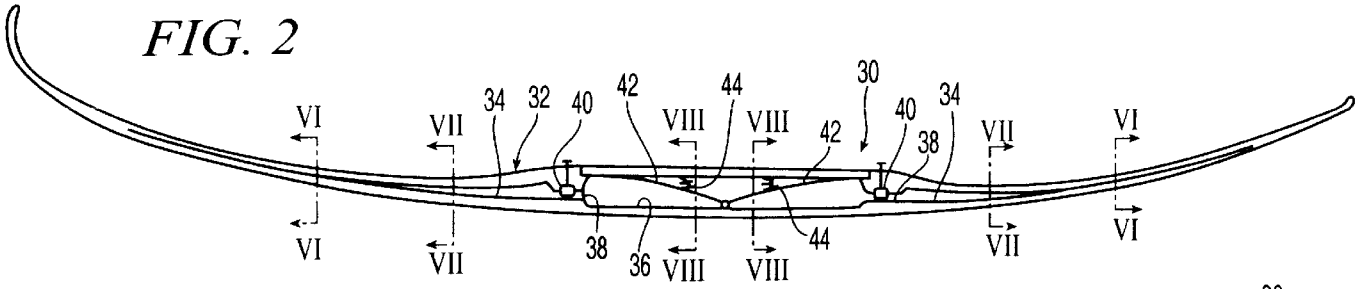
FIG. 2 schematically illustrates the ski of FIG. 1 in a curved configuration.

In the embodiment illustrated in FIGS. 1 and 2 the compensation chambers 36 are defined within respective resilient flexible and impermeable membranes 42 on the outer surface of which act resilient means, for example in the form of compression coil springs 44.

The deformable chambers 34 may also be defined within a flexible impermeable membrane 46 as illustrated in FIGS. 3, 4, 6 and 7. Alternatively, the deformable chambers 34 may be formed by cavities within the structure 32 of the ski, rendered impermeable in various ways.

The deformable chambers 34 are filled with a damping fluid of various kind, preferably a liquid, with viscosity characteristics selected in dependence on the damping characteristics which it is desired to obtain. In the rest configuration of the ski illustrated in FIG. 1 the damping fluid also partly fills the compensation chambers 36. The damping fluid may also be constituted simply by air. In this case the air can be expelled from the deformable chambers through narrow passages to the atmosphere and may be subsequently sucked in without the need for compensation chambers.

The deformable chambers 34 are disposed and formed in such a way that the variations in configuration of the structure 32 of the ski cause corresponding variations in the form of at least a part of the deformable chambers 34. This is obtained, for example, by disposing the deformable chambers 34 between two opposed surfaces 48, 50 belonging to an upper element 52 and a lower element 54 respectively forming part of the structure 32 of the ski 30. The elements 52, 54 which may, for example, be monolithic or layered sheets of composite material, are connected together by resiliently yielding flanks 56 for example of elastomeric material. In a conventional way the element 54 carries a sliding sole plate 58 of plastics material, graphite or the like, and a pair of metal edges 60.

Figure 5:
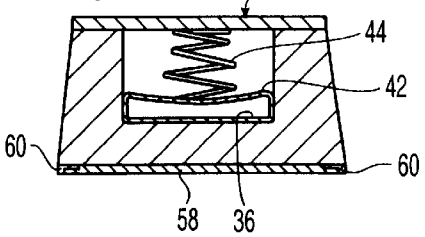
FIGS. 3 to 5 are schematic transverse sections taken on the lines III—III, IV—IV and V—V of FIG. 1.
Figure 4:
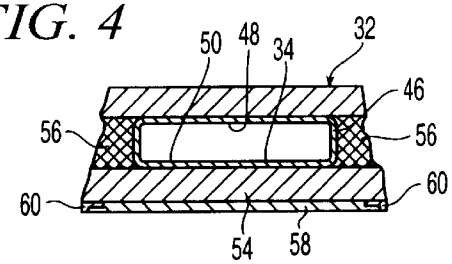
Figure 3:
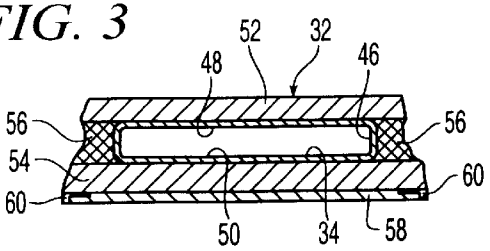
Figure 8:
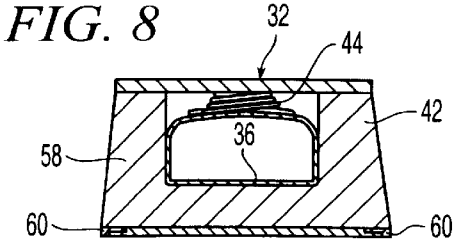
FIGS. 6 to 8 are transverse sections similar to those of FIGS. 3 to 5, relating to the curved configuration of the ski of FIG. 2 and taken on the lines VI—VI, VII—VII and VIII—VIII of FIG. 2.
Figure 7:
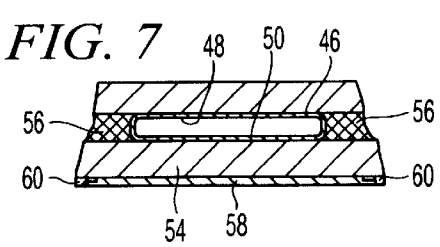
Figure 6:
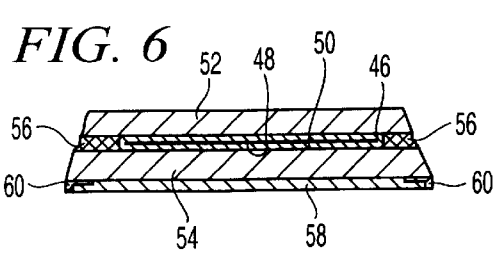

By comparing the shape of the ski 30 in its rest condition (FIGS. 1, 3, 4 and 5) and in a curved configuration (FIGS. 2, 6, 7 and 8) it is noted that the curvature of the structure 32 causes a compression of the deformable chambers 34 between the opposed surfaces 48, 50 of the elements 52 and 54. This compression causes a general reduction in volume of the chambers 34 and obliges the damping fluid initially contained in the chambers 34 to flow into the compensation chambers 36. As illustrated in FIGS. 5 and 8 this causes an increase in volume of the compensation chambers 36, which causes compression of the elastic elements 44. After release of the external forces which caused the curvature of the ski 30 the structure 32 of the ski returns to its rest configuration and allows an expansion of the deformable chambers 34. In this way the fluid contained in the compensation chambers 36 flows back into the deformable chambers 34 under the action of the resilient elements 44. This movement of the damping fluid along the deformable chambers 34 and through the passage from the deformable chambers 34 to the compensation chambers 36 extracts energy from the elastic vibration of the structure 32 and causes damping in a similar manner to that which takes place in a piston-type damper.

In the embodiment illustrated above there are provided two deformable chambers 34 independent from one another and connected to respective compensation chambers 36. This arrangement can be varied at will in dependence on the constructional requirements. For example, a single deformable chamber 34 could be provided, connected to one or more expansion chambers disposed anywhere in the structure of the ski. Three or more independent or interconnected deformable chambers could also be provided.

The deformable structure 32 of the ski 30 could also be modified in various ways with respect to that illustrated by way of example in FIGS. 3 to 8. For example the system according to the invention could easily be implemented in skis with a structure of the so-called "monocoque" type one embodiment of which is schematically illustrated in FIGS. 9 to 14 of which FIGS. 9 to 11 are transverse sections of the ski in its undeformed configuration whilst FIGS. 12 to 14 represent the same sections in a curved or flexed configuration of the ski.

The "monocoque" structure comprises a monolithic shell 62 in which the upper element 52 and the yielding flanks 56 are defined. In FIGS. 11 to 14 there is illustrated an alternative embodiment for the elastic means which cooperate with the compensation chambers 36. In this embodiment, instead of a coil spring there is illustrated the use of a gas spring 64 constituted by an impermeable elastic membrane 66 filled with a highly deformable fluid for example air.

Naturally, the gas spring 64 could also be utilised in the previously-illustrated structure with reference to FIGS. 3 to 8. Moreover, the possibility is envisaged of providing a weight, constituted for example by a metal plate, which acts by gravity on the compensation chamber. This weight could replace or be combined with the spring system.

Figures 9, 10, 11, 12, 13, 14, 15, 16:
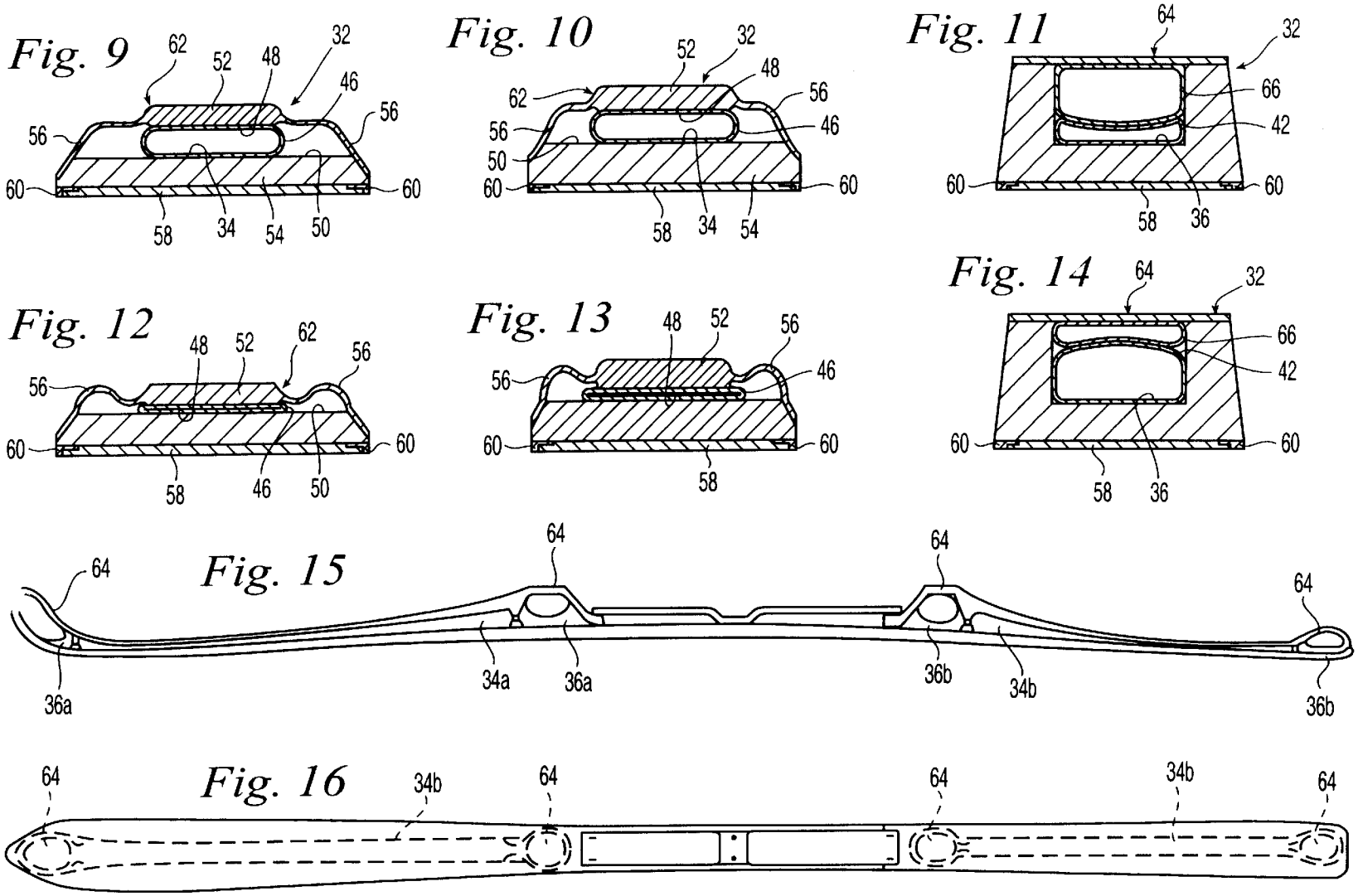
FIGS. 9 to 14 are transverse sections respectively corresponding to those of FIGS. 3 to 8, relating to a ski with a different structure.
FIG. 15 is a schematic longitudinal section illustrating a second embodiment of a ski according to the present invention.
FIG. 16 is a plan view of the ski of FIG. 15.

In FIGS. 15 to 16 there is illustrated by way of example a different constructional choice for the arrangement of the expansion chambers 36. In this embodiment there are provided two deformable chambers 34*a* and 34*b* disposed in the forward or tip section and in the tail section of the ski. The chamber 34*a* in the forward portion communicates with two expansion chambers 36*a* disposed one at the tip of the ski and the other at the central section. The deformable tail chamber 34*b* also communicates with two expansion chambers 36*b* disposed at the tail end and in the central section of the ski. Each compensation chamber 36*a*, 36*b* cooperates with an elastic element 64 constituted for example by a gas spring.

Figure 18:
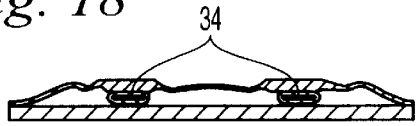
FIG. 18 is a section taken on the line XVIII—XVIII of FIG. 17.
Figure 21:
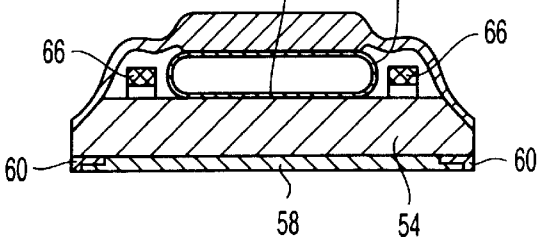
FIGS. 21 and 22 are transverse sections taken respectively along the lines XXI—XXI and XXII—XXII of FIGS. 19 and 20.
Figure 22:
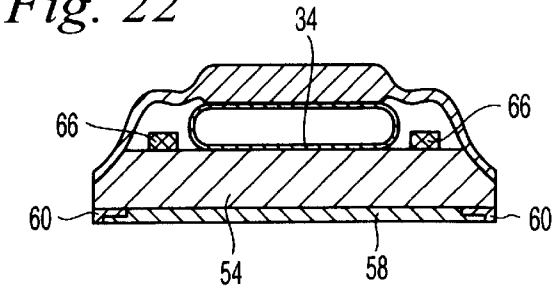
Figure 17:
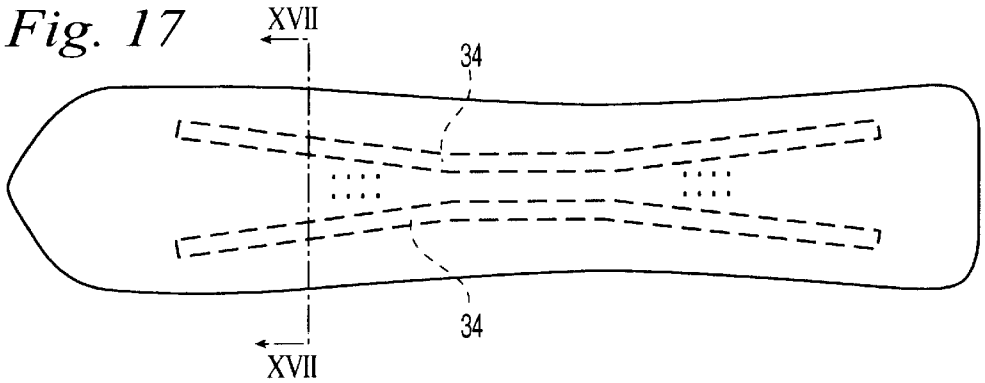
FIG. 17 is a plan view of a snowboard provided with a system according to the invention.
Figure 19:
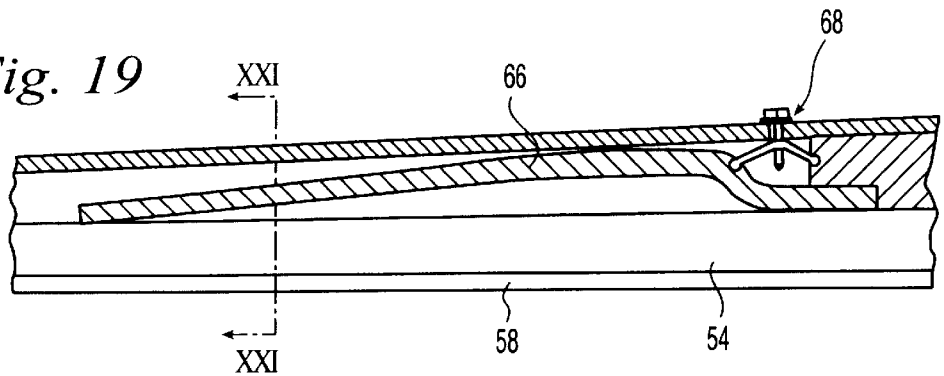
FIGS. 19 and 20 are partial longitudinal sections of a ski according to the invention provided with a device for adjusting the flexural rigidity, in two different adjustment positions.
Figure 20:
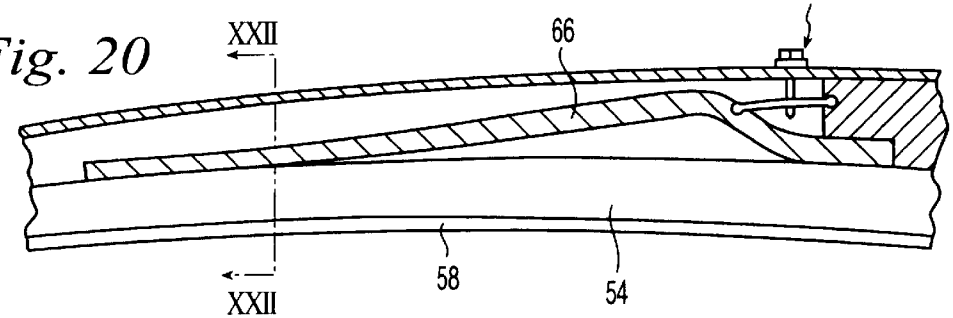

FIGS. 17 to 18 schematically illustrate the use of a system according to the present invention in a snowboard. In this case the greater width of the snowboard makes it possible to have available two or more deformable chambers 34 in side-by-side relationship. In the embodiment illustrated there are provided two deformable chambers 34 disposed, in plan, in a generally X-shape configuration. The operation of the damping system is similar to that described above in relation to alpine skis.

FIGS. 19 to 22 illustrate an embodiment of the invention in which, in addition to the vibration damping device described above, there is provided an elastic system for regulating the rigidity and/or the rest-condition aspect of the ski. This device includes elastic means, for example in the form of a pair of flat pre-loaded springs 66, formed for example of composite material such as glass or carbon fibres. The springs 66 can be disposed alongside the membrane 46 defining the deformable chamber 34. The flat springs 66 are fixed rigidly to the central part of the equipment and rest on the front and/or rear parts thereof. The flat springs 66 can be associated with a device 68 of various type by which it is possible to adjust the free bending length of the spring 66. This adjustment translates into a variation in the flexural rigidity of the ski and likewise into a modification of the shape of the ski at rest (compare FIGS. 19 and 20). This possibility of adjusting the curvature of the ski in the rest condition also makes it possible to vary the compression stroke of the deformable chambers 34 and influences the damping conditions of the system. The adjustment of the rigidity also makes available a system for reinstatement, after intensive use, of a perfect match between one ski and the other of the same pair the original rigidity or precurvature of which normally declines at different rates.

Figure 23:
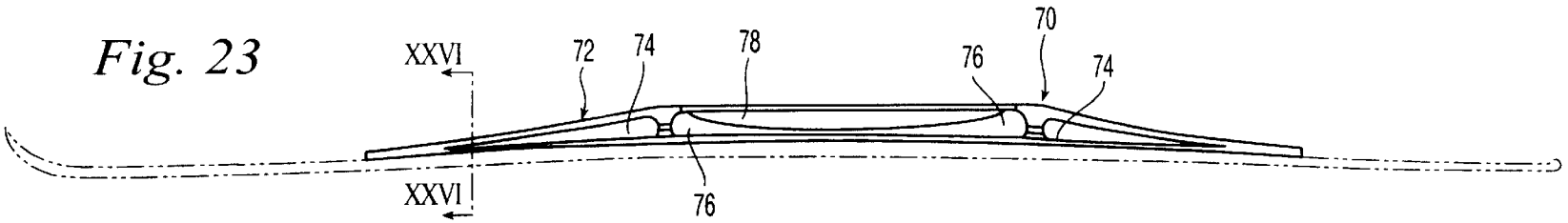
FIG. 23 schematically illustrates an accessory which can be applied to a ski, provided with a damping system according to the invention.

FIG. 23 illustrates an accessory 70 which can be fixed on to the upper surface of a ski for the purpose of reducing flexural vibrations of this latter. The accessory 70 further allows an increase in the distance between the boot and the ground like a normal spacer plate at the central portion of the ski. The accessory 70 comprises a deformable structure 72 within which are defined one or more deformable chambers 74 (two in the example of FIG. 23) communicating with compensation chambers 76. In this case, too, the compensation chambers 76 also cooperate with an elastic element 78 constituted for example by a gas spring.

In use, the deformable structure 72 of the accessory 70 flexes in dependence on the deformation of the ski to which it is fixed. The deformation of the accessory 70 causes a damping thanks to the fluid movement which takes place in a similar manner to that hereinbefore described.

Figure 25:
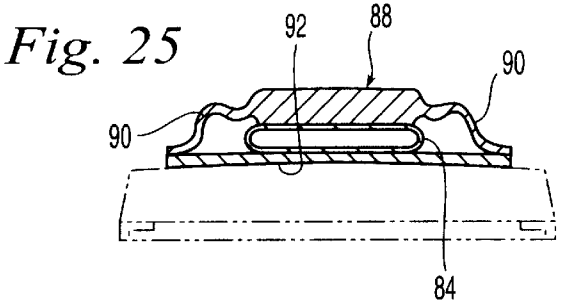
FIG. 25 is a constructional variant of the equipment illustrated in FIG. 24.
Figure 24:
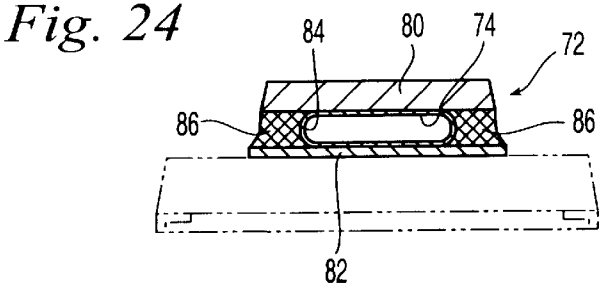
FIG. 24 is a schematic section taken on the line XXIV—XXIV of FIG. 23.

FIGS. 24 and 25 illustrate two alternative variants of the transverse section of the accessory 70. In the embodiment of FIG. 24 the structure 72 of the accessory 70 has two parallel layers 80 and 82 possibly of variable cross-section, between which is disposed a membrane 84 within which is defined the deformable chamber 74. A pair of deformable flanks 86 connect the layers 80, 82 together.

In the variant of FIG. 25 the deformable structure 72 of the accessory 70 has a monolithic upper body 88 with flexible sides 90 connected to a lower layer 92. A membrane 84 is also compressed between the upper body 88 and the lower layer 92.

Figure 26:
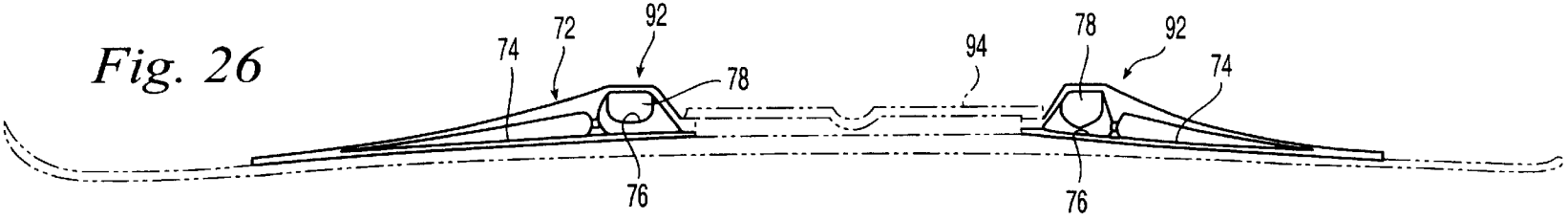
FIG. 26 illustrates an accessory constituting a variant of that of FIG. 23.
Figure 27:
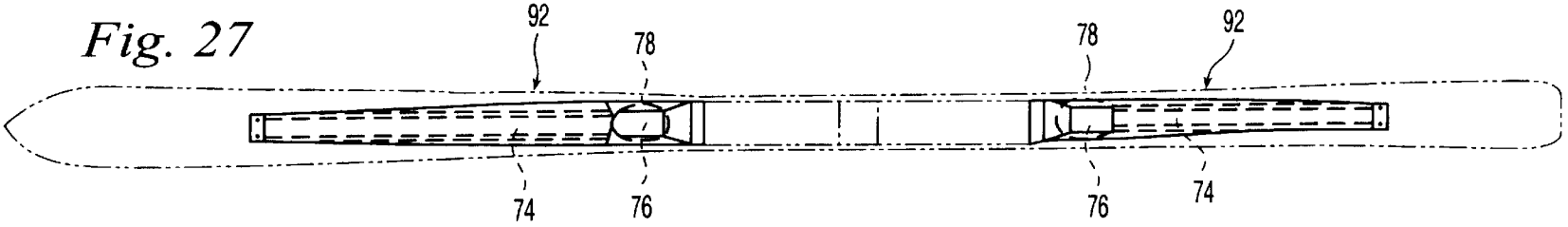
FIG. 27 is a plan view of the accessory of FIG. 26.

In the other variant illustrated in FIGS. 26 and 27 there is illustrated an accessory 70 similar to that described hereinabove with reference to FIG. 23, constituted by two separate portions 92 each of which has a deformable structure 72 within which is formed a deformable chamber 74 and a compensation chamber 76 with associated elastic means 68. A plate 94 for fixing the bindings may be interposed between the two elements 92.

What is claimed is:

1. Skiing equipment comprising an elastically deformable structure (32, 72) which can assume a variety of curved configurations in dependence on the dynamic actions which occur in use, the deformable structure (32, 72) being associated with means for damping its flexural vibrations, the said damping means comprising at least one deformable chamber (34, 74) filled with a damping fluid and disposed in such a way that the variations in the configuration of the deformable structure (32, 74) cause corresponding variations in the form of at least a part of the said deformable chamber (34, 74) the said deformable chamber (34, 74) communicating with at least one compensation chamber (36, 76) acting to receive the fluid from the deformable chamber (34, 74) in conditions in which a variation in configuration of the structure of the ski involves a reduction in the volume of the deformable chamber (34, 74) and acting to supply fluid to the deformable chamber (34, 74) in conditions in which a variation in configuration of the structure involves an increase in the volume of the deformable chamber (34, 74).

2. Skiing equipment according to claim 1, comprising a forward portion, a rear portion and a central portion intended for the fixing of bindings and at least one deformable chamber (34, 74) extending longitudinally within one of said forward or rear portions.

3. Skiing equipment according to claim 1, wherein at least one deformable chamber (34, 74) extends within a portion of said deformable structure (32, 72) including upper and lower elements (48, 50, 80, 82) connected together by resiliently yielding flanks (56, 86) arranged in such a way that said upper and lower elements (48, 50, 80, 82) move toward and away from one another in dependence on the variation in the configuration of the structure (32, 72).

4. Skiing equipment according to claim 1, wherein the compensation chamber (36, 76) cooperates with means (44, 64, 78) operable to exert on the fluid an action which causes the fluid to flow into the deformable chamber (34, 74) in the said conditions in which an increase in the volume of the deformable chamber (34, 74) occurs.

5. A ski or snowboard incorporating an equipment according to claim 1.

6. An accessory intended to be fixed on a ski or snowboard incorporating an equipment according to claim 1.

7. Skiing equipment according to claim 2, comprising at least at least one compensation chamber (36, 76) placed in said central portion.

8. Skiing equipment according to claim 2, comprising at least at least one compensation chamber (36, 76) placed in correspondence with one end of the equipment.

9. Skiing equipment according to claim 4, wherein the compensation chamber is defined within a flexible membrane (42) and in that the said means (44, 64, 78) exert a compression force on the outer surface of this membrane.

* * * * *